US010722417B2

(12) United States Patent
Yu

(10) Patent No.: US 10,722,417 B2
(45) Date of Patent: Jul. 28, 2020

(54) VERTEBRA RECOVERY APPARATUS

(71) Applicant: Mu-Cun Yu, Taichung (TW)

(72) Inventor: Mu-Cun Yu, Taichung (TW)

( * ) Notice: Subject to any disclaimer, the term of this patent is extended or adjusted under 35 U.S.C. 154(b) by 1034 days.

(21) Appl. No.: 15/103,315

(22) PCT Filed: Mar. 11, 2014

(86) PCT No.: PCT/CN2014/090179
§ 371 (c)(1),
(2) Date: Jun. 10, 2016

(87) PCT Pub. No.: WO2015/113427
PCT Pub. Date: Aug. 6, 2015

(65) Prior Publication Data

US 2016/0346154 A1 Dec. 1, 2016

(30) Foreign Application Priority Data

Jan. 29, 2014 (CN) ..... 2014 1 0042638

(51) Int. Cl.
*A61H 1/02* (2006.01)

(52) U.S. Cl.
CPC ..... *A61H 1/0292* (2013.01); *A61H 1/0229* (2013.01); *A61H 2201/1215* (2013.01); *A61H 2201/1284* (2013.01); *A61H 2201/1616* (2013.01); *A61H 2201/1676* (2013.01); *A61H 2203/0487* (2013.01)

(58) Field of Classification Search
CPC combination set(s) only.
See application file for complete search history.

(56) References Cited

U.S. PATENT DOCUMENTS 3,986,502 A * 10/1976 Gilson ..... A61H 3/00 602/11

* cited by examiner

*Primary Examiner* — Ophelia A Hawthorne

(57) ABSTRACT

A vertebra recovery apparatus has a main frame body, a swing assembly, and a driving module. The swing assembly is pivotally disposed on the main frame body, and is provided with two cantilevers. Each of the two cantilevers is provided with a support piece used for providing support under an armpit of each of the two arms of a human body, so that the human body stands in the swing assembly in a manner of suspending the feet. The driving module is disposed between the main frame body and the swing assembly, and may drive the swing assembly to perform motion of swinging forwards and backwards. The vertebra recovery apparatus performs stretching by using the weight of a user, and achieves the effects of enabling a vertebra to be fully stretched and to be in a normal location.

10 Claims, 7 Drawing Sheets

VERTEBRA RECOVERY APPARATUS

FIELD OF THE INVENTION

The present invention relates to a recovery apparatus, especially relates to a vertebra recovery apparatus. It may improve vertebra compression and train arm muscles and abdominal muscles so as to improve pain and discomfort of the vertebra.

BACKGROUND OF THE INVENTION

Depending on skeletal system, human beings can stand to walk. The stand of the skeletal system is vertebra. A top end of the vertebra is connected with the skull, a bottom end of the vertebra is connected with the sacrum, and a section between of the top end and the bottom end of the vertebra protect the marrow. The marrow is the core of peripheral nerves. The peripheral nerves are extended leftward and rightward from the vertebra in pairs and then extended forward and upward and downward. Besides the peripheral nerves, sympathetic nerve and the parasympathetic nerve of the autonomic nervous system are also connected. Therefore, the vertebra is the start of the neutral networks. Once the vertebra is skewed and/or dislocated, the nerves may be compressed or excited so that ache and dysfunction of organs of human body may be initiated. A patient whose vertebra is hurt or abnormal may have backache or quadriplegia which is no radical cure except performing an operation. According to clinical trials, stretching the vertebra may improve or relieve the pain resulting from the nerve compression. It may effectively improve the pain or discomfort caused by the vertebral anomaly to cooperate with moderate exercises to strengthen the peripheral muscles.

The dislocation of the vertebra may be caused by direct accidental impacts or long-term stress to result in muscular dystrophy and further skewing the position of the vertebra. Log-term incorrect pose may also cause dislocation of the vertebra so as to make the spinal nerve be compressed. The spinal nerve is responsible for transmitting the messages to each main organs. Therefore, the compressed spinal nerve may not effectively transmit the messages so as to influence the operation of the organs. Except the direct incidental impacts, the vertebra may be stretched and adjusted to the correct locations/positions so as to relieve or avoid the pain.

In recent years, the inversion machines to suspend the human body upside down are developed and various, such as Taiwanese patent no. 238215, 239972, 315733, 350346, and 492281. The user may lie on his/her back to the lying pad and two feet hook a positioning base. And then, the inversion machine is started to perform the inverse operation. Therefore, the feet may be stretched by his/her own weight so as to stretch the vertebra fully to be in correct locations/positions.

However, since the user lies on his/her back to the lying pad, the user may not know immediately the stretching status and angle while operating the inversion machine. And the stretching pose or length may be not adjusted in detail while operating the inversion machine. Besides, since the user is supported by the lying pad, it may be not stretched with small inversion angle and the stretching effect is limited. Furthermore, because the user must be head over heels while operating the inversion machine, the head must be congested with bloods and it is easy to result in blood congestion and feeling dizzy. When the user left, he/she may not stand firmly to fall down.

In other words, the recent inversion machines are limited in use and hard to satisfy the demands of the users. The training of strengthening the peripheral muscles may be reduced to influence the effects of improving the pain and discomfort of the vertebra. Therefore, how to effectively stretch and make the bloods flow smoothly and further train the muscles in different parts of the human body is the key difficulty need to be solved.

In view of the foregoing circumstances, the inventor has invested a lot of time to study the relevant knowledge, compare the pros and cons, research and develop related products. After quite many experiments and tests, the "vertebra recovery apparatus" of this invention is eventually launched to improve the foregoing shortcomings, to meet the public use.

SUMMARY OF THE INVENTION

An object of this invention is providing a vertebra recovery apparatus. The user may be stretched downwardly by his/her own weight in right position. The stretching strength may be adjusted. The effect of rehabilitation or recovery may be improved by swinging.

Another object of this invention is providing a vertebra recovery apparatus. The muscles of the arms, the back, and the abdomen may be exerted in series to achieve the effects of training muscles and exercise. It may further improve the pain or discomfort of the vertebra and provide the effect of exercise.

To achieve above objects, a vertebra recovery apparatus comprises a main frame body; a swing assembly, pivotally disposed on the main frame body and having two cantilevers, a middle section of each cantilever is provided with a support piece used for providing support under an armpit of each of the two arms of a human body so that the human body stands in the swing assembly in a manner of suspending the feet; and a driving module, disposed between the main frame body and the swing assembly, the driving module may drive the swing assembly to perform motion of swinging forwards and backwards.

In some embodiments, the main frame body has two stands arranged opposite to each other, the swing assembly has a shaft located between two top ends of the two stands, a top end of each cantilever has an axle sleeve pivoted to the shaft for providing the swing assembly to swing and pivot relative to the main frame body.

In some embodiments, a height of the support piece may be selectively adjusted, and a top support portion is arranged at a top surface of the support piece for supporting the armpit of the human body, and a handle is arranged at an outside of the support piece for holding.

In some embodiments, a first through hole is formed at the middle section of each cantilever for providing the support piece to slide up and down, two opposite inner sides of the first through hole have a first guiding portion respectively, two opposite side walls of the support piece have a second guiding portion respectively corresponding to the first guiding portion, a plurality of adjusting holes is formed on the cantilevers and the support piece from top to bottom in series so that a pin may be passed through one of the adjusting holes to match a height of the armpit of the human body.

In some embodiments, a riser assembly is arranged at two lower sections of the two cantilevers for each and the riser assembly is formed by a plate and the plate is capable for interposing between the two cantilevers, and a height of the plate may be selectively adjusted.

In some embodiments, a second through hole is formed at the lower section of each cantilever, two opposite inner sides of the second through hole have a third guiding portion respectively, a sliding block is arranged at each end of the plate of the riser assembly and slidably arranged in the second through hole corresponding to the lower sections of the two cantilevers, two opposite side walls of the sliding block has a fourth guiding portion respectively corresponding to each third guiding portion, a screw hole is formed at the sliding block, and a driving assembly is arranged on the riser assembly corresponding to each cantilever, an output end of the driving assembly has a screw rod for screwing with the screw hole of the sliding block to drive the sliding block to move up and down.

In some embodiments, the swing assembly has a width adjusting module, and the width adjusting module is arranged on the main frame body.

In some embodiments, the width adjusting module has a driving assembly arranged on a top plate of the main frame body, the driving assembly has an output screw rod, the output screw rod has a left threading section and a right threading section, two screw barrels are screwed with the left threading section and the right threading section respectively, a claw portion is arranged under each screw barrel, an elongated slot is formed at the top plate for providing the claw portion of each screw barrel to pass through, each claw portion is pivoted with the axle sleeve of each cantilever so as to drive the two cantilevers to move close to or away from each other to adjust a width between two cantilevers for matching the human body while the driving assembly of the width adjusting module is rotated clockwise or counter-clockwise.

In some embodiments, the driving module is arranged under the swing assembly, the driving module has a base arranged in the main frame body, two driving wheels are arranged on the base and corresponding to the two cantilevers, a bottom end of each cantilever has a touch pad so that the driving module may use the friction between the driving wheels and the touch pad to drive the swing assembly to swing forward and backward.

In some embodiments, a stand assembly arranged on the swing assembly, the stand assembly includes a buttock pad arranged in a rear side of the two cantilevers and corresponding to a buttock of the human body, the stand assembly further includes an abdomen pad arranged at a front side of each cantilever, the abdomen pad may be selectively buckled to support the human body.

Therefore, the advantages of the present invention may be described as follows.

Firstly, the human body may be swung forward and backward by the swing assembly and the feet are suspended. The user may be stretched by his/her own weight to fully stretch the vertebra to be in right position.

Secondly, two hands of the user may support on the support pieces of the cantilevers to exert the muscles of the buttock, the back, and the abdomen in series so as to achieve the effect of training muscles.

Thirdly, the pose of the user may be not necessary to change and the user may know the stretching status and angle of the vertebra so as to adjust the swinging angle and speed of the stretching pose or length while operating.

Fourthly, It may not be head over heels happened by the inversion machine. The user may be not dizzy due to head congestion to prevent from falling down and improve safety.

Further features and advantages of the present invention will become apparent to those of skill in the art in view of the detailed description of preferred embodiments which follows, when considered together with the attached drawings and claims.

BRIEF DESCRIPTION OF THE DRAWINGS

All the objects, advantages, and novel features of the invention will become more apparent from the following detailed descriptions when taken in conjunction with the accompanying drawings.

DESCRIPTION OF THE PREFERRED EMBODIMENT

Figure 1:
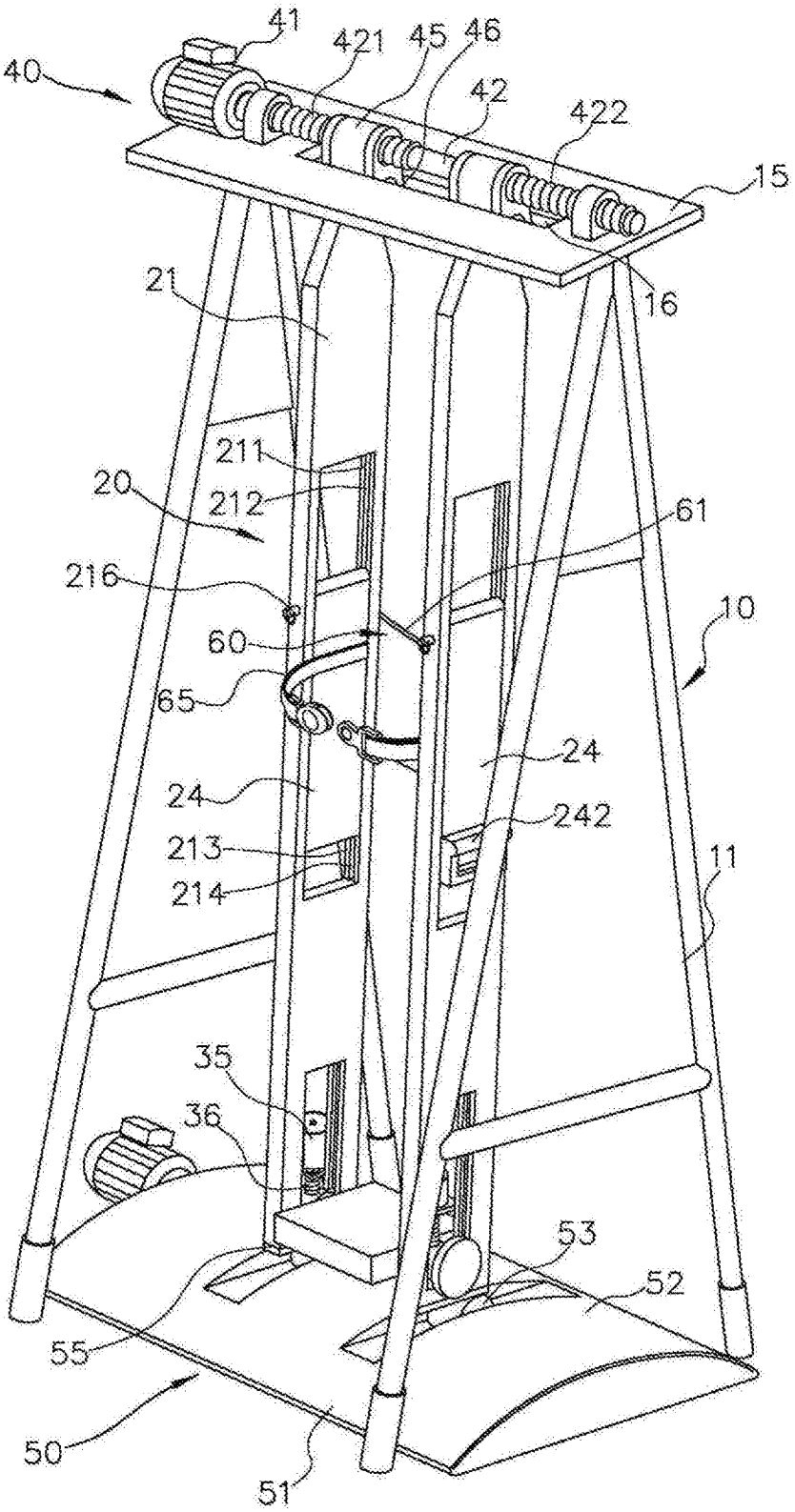
FIG. 1 is a perspective view of a vertebra recovery apparatus of the present invention.

Referring now to the drawings where like characteristics and features among the various figures are denoted by like reference characters.

Figure 2:
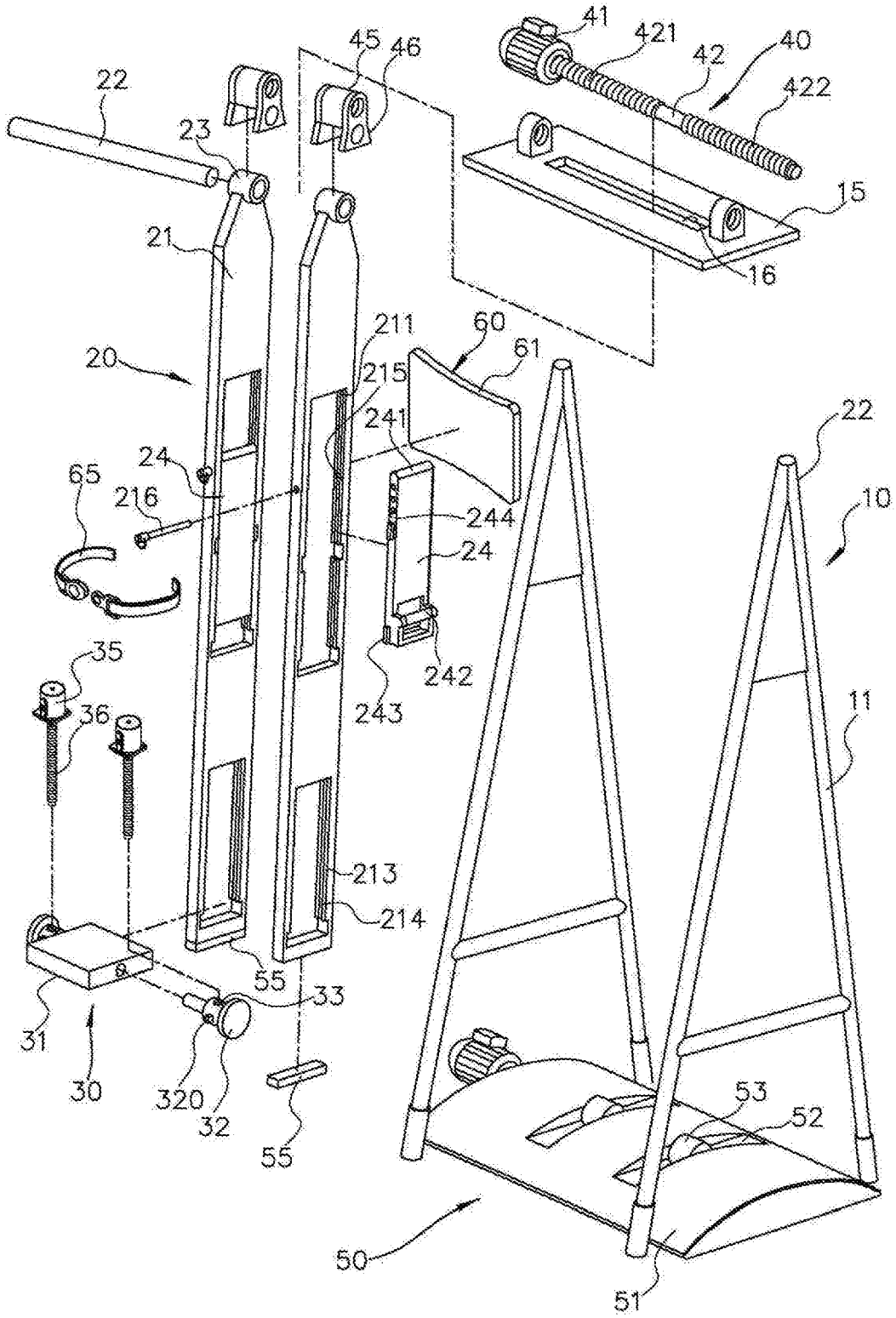
FIG. 2 is an exploded view of the vertebra recovery apparatus of the present invention.

Please refer to FIGS. 1 and 2, a vertebra recovery apparatus may at least comprise a main frame body 10, a swing assembly 20, and a driving module 50. The driving module 50 may drive the swing assembly 20 to swing. The swing assembly 20 may push a human body to swing forward and backward relative to the main frame body 10.

The main frame body 10 has two A-shaped stands which are arranged opposite to each other. A top plate 15 is arranged on the two stands 11 for proving the main frame body 10 to firmly stand on the ground and being capable for assembling the swing assembly 20 and the driving module 50.

The swing assembly 20 is pivotally disposed on the main frame body 10 and has two cantilevers 21 for supporting a human body. The swing assembly 20 has a shaft 22 which is located between the top ends of the two stands 11 and a top end of each cantilever 21 has an axle sleeve 23 which is pivoted to the shaft 22 for providing the swing assembly 20 to swing and pivot relative to the main frame body 10. A middle section of each cantilever 21 may be provided with a support piece 24. A first through hole 211 is formed at the middle section of each cantilever 21 for providing the support piece 24 to slide up and down. Two opposite inner sides of the first through hole 211 have a first guiding portion 212 respectively. A top surface of the support piece 24 has a top support portion 241 for supporting an armpit of the human body. A handle 242 may be arranged at an outside of the support piece 24 for providing to be held. A height of the support piece 24 may be selectively adjusted. That is, a height of the handle 242 may be adjusted relative to the top support portion 241 for matching the length of the arm of the human body. Two opposite side walls of the support piece 24 may have a second guiding portion 243 respectively corresponding to the first guiding portion 212. A plurality of adjusting holes 215, 244 is formed on the cantilevers 21 and the support piece 24 from top to bottom in series so that a pin 216 may be passed through one of the adjusting holes 215 of the cantilevers 21 and corresponding one of the adjusting holes 244 of the support piece 24 to match a height of the armpit of the human body. A riser assembly 30 may be arranged at the lower sections of the two cantilevers 21 which are capable for selectively adjusting height. A second through hole 213 may be formed at a lower section of each cantilever 21 for providing the riser assembly 30 to move up and down. Two opposite inner sides of the second through hole 213 have a third guiding portion 214 respectively. The riser assembly 30 may be formed by a plate 31 which is capable for interposing between the two cantilevers 21. A sliding block 32 may be arranged at each end of the plate 31 of the riser assembly 30 and slidably arranged in the second through hole 213 corresponding to the lower sections of the two cantilevers 21. Two opposite side walls of the sliding block 32 has a fourth guiding portion 320 respectively corresponding to each third guiding portion 214. A screw hole 33 may be formed at the sliding block 32. A driving assembly 35 may be arranged on the riser assembly 30 corresponding to each cantilever 21. An output end of the driving assembly 35 may have a screw rod 36 for screwing with the screw hole 33 of the sliding block 32 to drive the sliding block 32 to move up and down.

Figure 3:
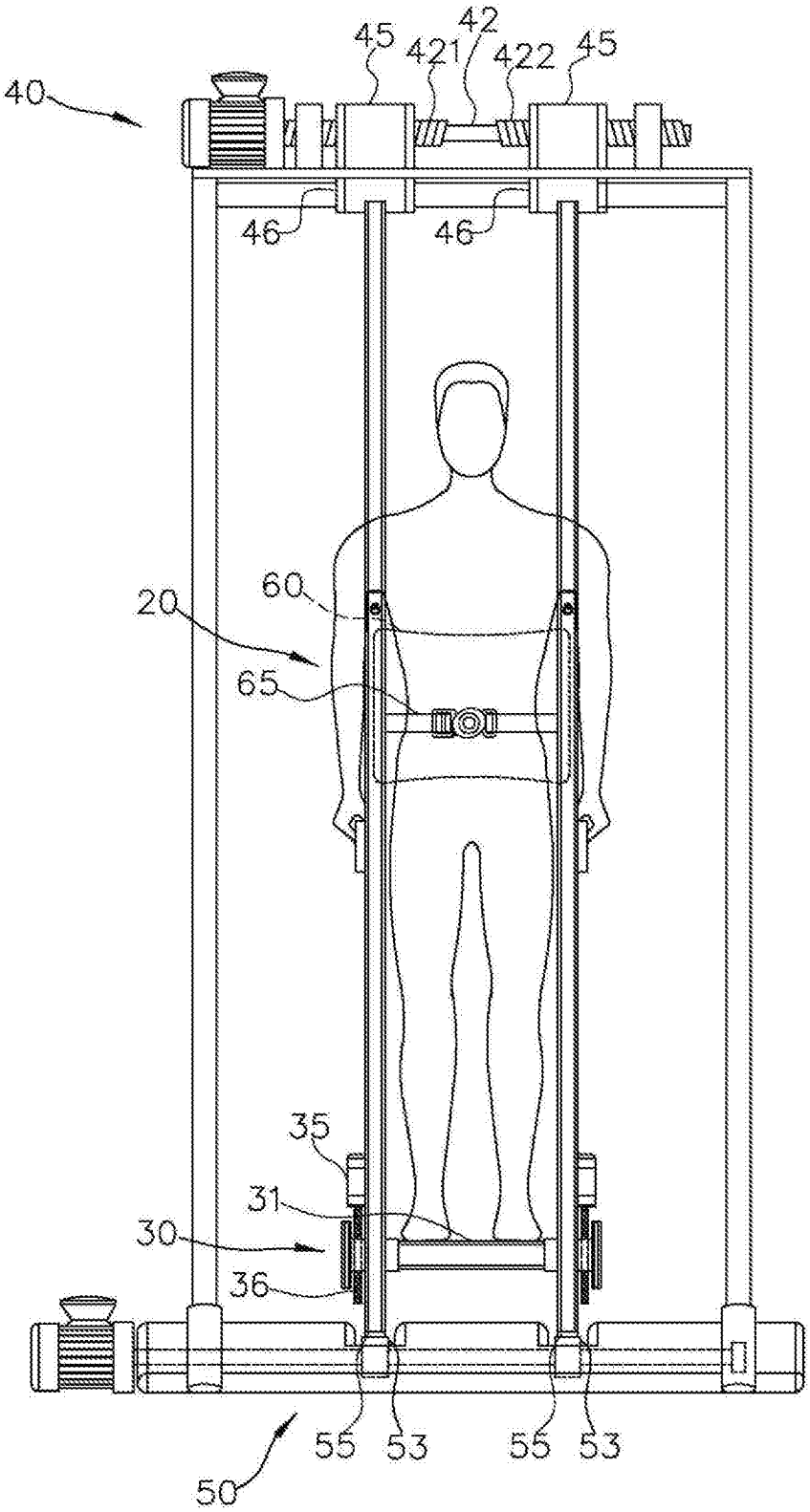
FIG. 3 is a front view of the vertebra recovery apparatus of the present invention.
Figure 4:
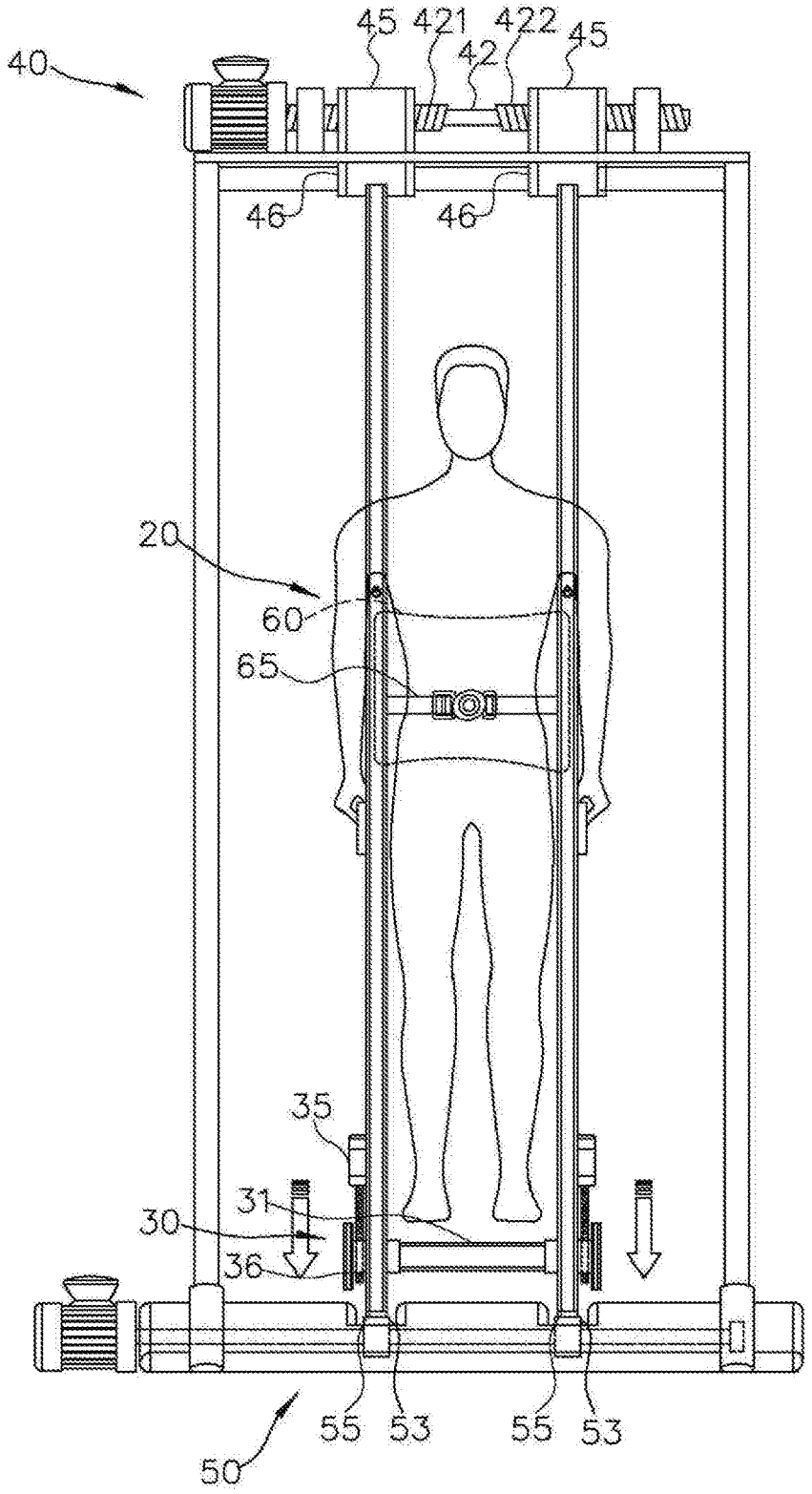
FIG. 4 is a view of the vertebra recovery apparatus of the present invention while being operated in a first operation status.
Figure 5:
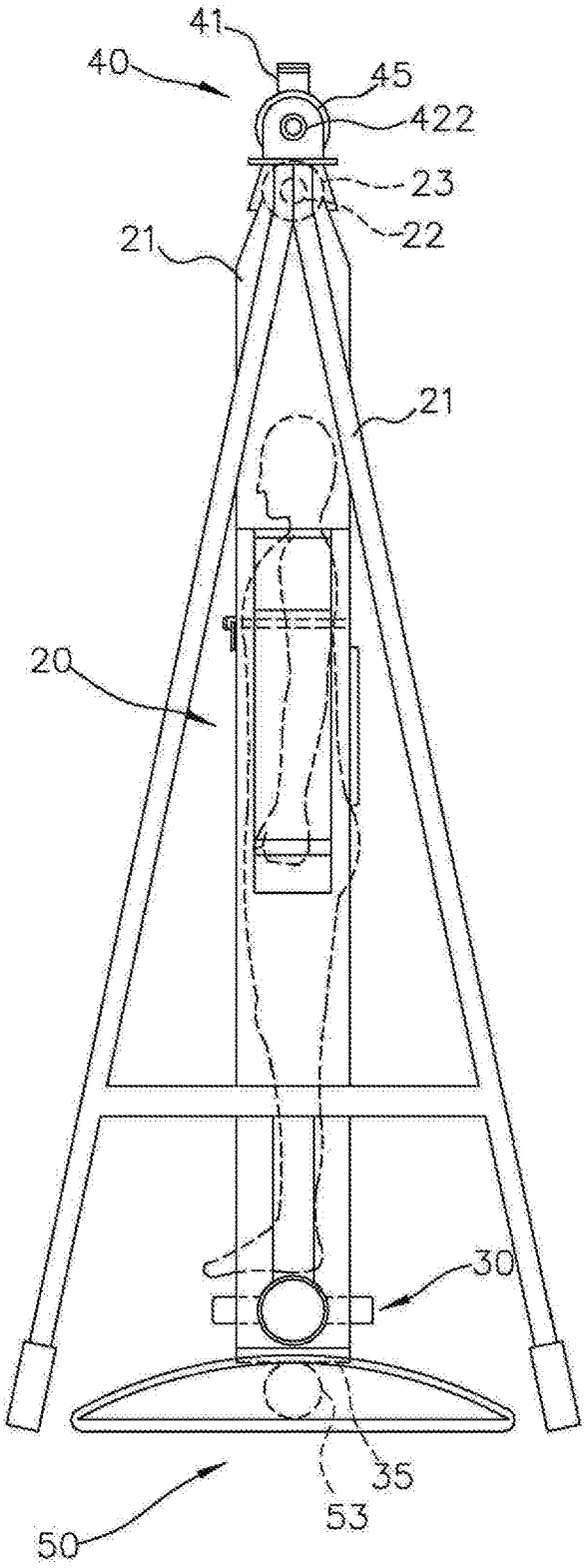
FIG. 5 is a side view of the vertebra recovery apparatus of the present invention.
Figure 6:
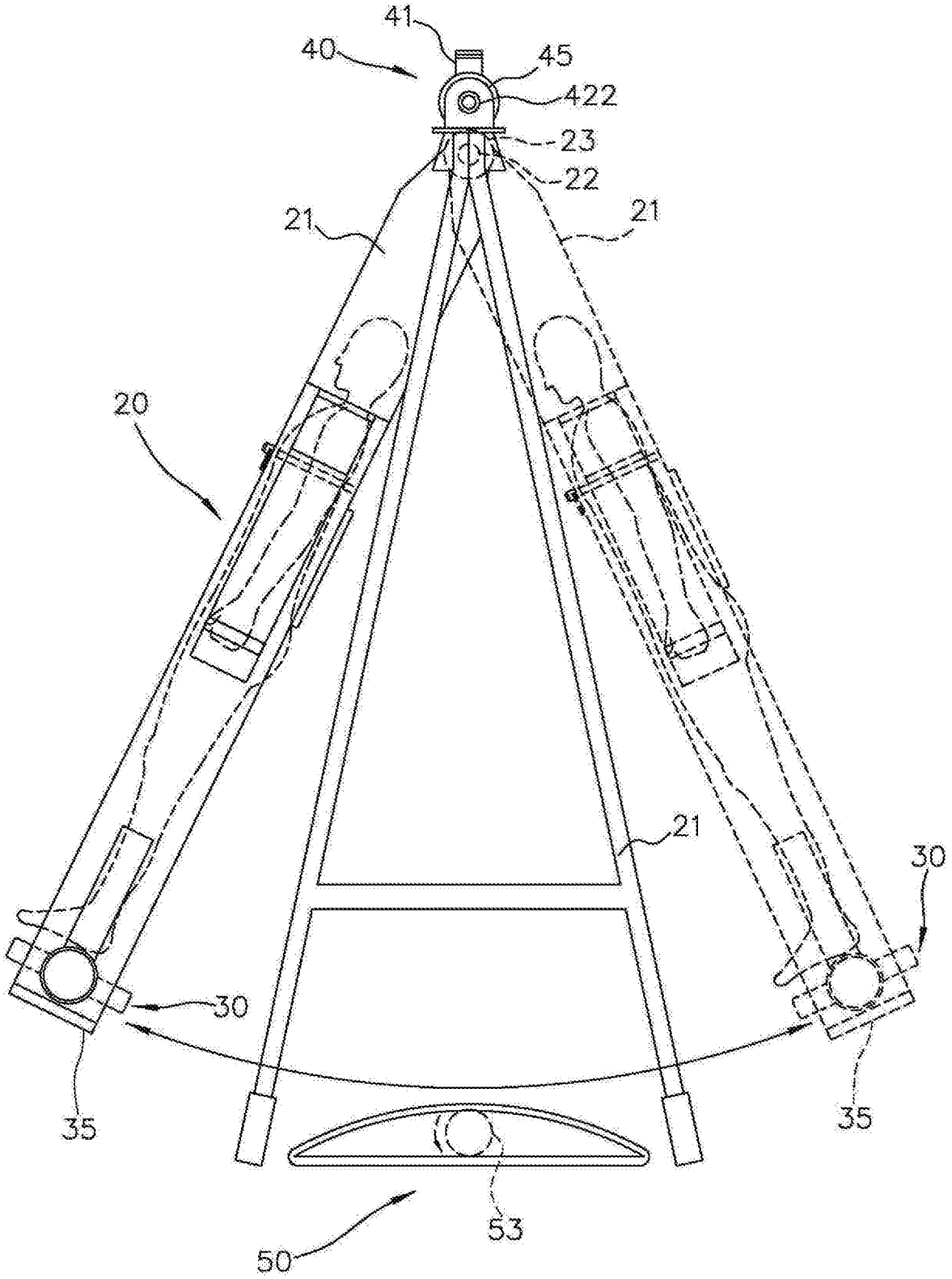
FIG. 6 is view of the vertebra recovery apparatus of the present invention while swinging.
Figure 7:
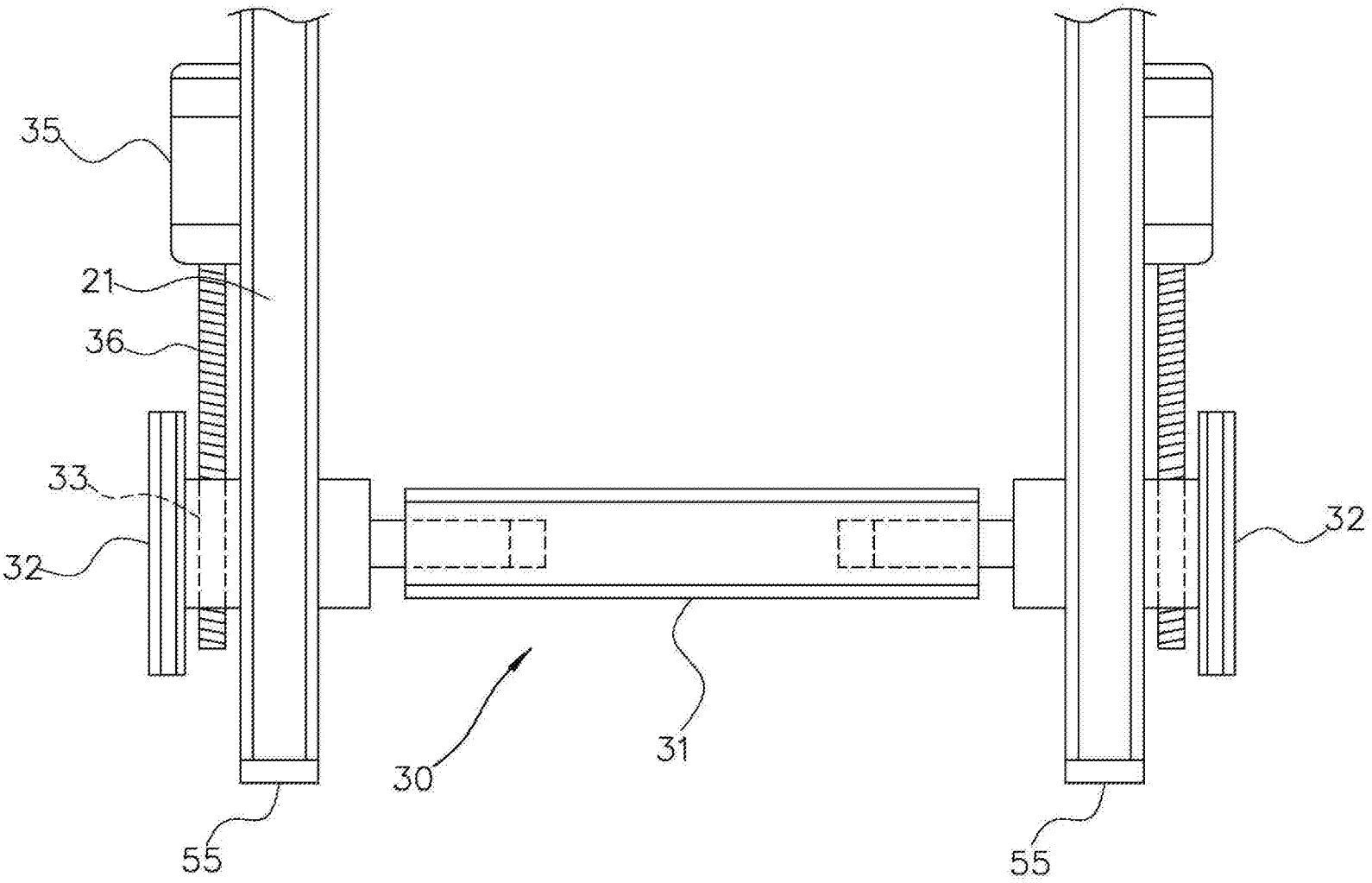
FIG. 7 is view of a riser of the vertebra recovery apparatus of the present invention while the width between two cantilevers is adjusted wider.

In addition, please refer to FIGS. 3 and 7, the swing assembly 20 may have a width adjusting module 40 which is arranged on the main frame body 10. The width adjusting module 40 has a driving assembly 41 which is arranged on the top plate 15 of the main frame body 10. The driving assembly 41 has an output screw rod 42. The output screw rod 42 has a left threading section 421 and a right threading section 422. Two screw barrels 45 are screwed with the left threading section 421 and the right threading section 422 respectively. A claw portion 46 may be arranged under each screw barrel 45. An elongated slot 16 may be formed at the top plate 15 for providing the claw portion 46 of each screw barrel 45 to pass through. Each claw portion 46 is pivoted with the axle sleeve 23 of each cantilever 21 so as to drive the two cantilevers 21 of the swing assembly 20 to move close to or away from each other to adjust a width between two cantilevers 21 for matching the human body while the driving assembly 41 of the width adjusting module 40 is rotated clockwise or counterclockwise.

The driving module 50 is arranged under the swing assembly 20. The driving module 50 has a base 51 which is arranged in the main frame body 10. The base 51 has two guiding grooves 52 which correspond to the two cantilevers 21 respectively. The base 51 has two driving wheels 53 which are formed in the guiding grooves 52 respectively for stirring the swing assembly 20 with friction. A bottom end of each cantilever 21 has a touch pad 55 so that the driving module may use the friction of rotation between the driving wheels 53 and the touch pad 55 to drive the swing assembly 20 to swing forward and backward. Furthermore, the contact strength may be used for braking. Otherwise, the driving wheels 53 of the driving module 50 nay be further replaced by the electromagnetic members and the touch pad 55 of each cantilever 21 of the swing assembly 20 may be replaced by the magnetic members so that a magnetic field nay be formed between the electromagnetic members and the magnetic members to drive the swing assembly 20 to swing forward and backward. And the magnetic force may be used for braking.

A stand assembly 60 may be arranged on the swing assembly 20 for limiting the human body on the swing assembly 20. The stand assembly 60 includes a buttock pad 61 which is arranged in a rear side of the two cantilevers 21 and corresponding to a buttock of the human body to prevent the human body from sliding backwardly while the swing assembly 20 is swung forwardly. The stand assembly 60 further includes an abdomen pad 65 which is arranged at the front side of the two cantilevers and the abdomen pad 65 may be selectively buckled to support the abdomen of the human body to prevent the human body from sliding forwardly while the swing assembly 20 is swung backwardly.

Therefore, the vertebra recovery apparatus of the present invention is easy to operate and capable for stretching the human body.

Please refer to FIGS. 3 to 6, they show the operation of the vertebra recovery apparatus of the present invention. The user stands on the plate 31 of the riser assembly 30. Two hands of the user are passing through the first through holes 211 of the two cantilevers 21 respectively. The height of the support piece 24 of each cantilever 21 is adjusted so as to support the armpit of the user. Two hands of the user may hold the handles 242 of the support pieces 24. The buttock pad 61 or abdomen pad 65 of the stand assembly 60 arranged at the swing assembly 20 may be covered at the buttock and a front side of the abdomen of the user so as to prevent the user from dropping while operating.

After finishing the support operation, the driving assembly 35 on the riser assembly 30 may drive the plate 31 to lower so that the human body stands in the swing assembly 20 in a manner of suspending the feet and the vertebra of the user may be stretched by user's own weight. Since the driving wheels 53 of the driving module 50 are contacted with the touch pad 55 of each cantilever 21 of the swing assembly 20, the swing assembly 20 may be driven to swing forward while the driving wheels 53 are rotating. The swing assembly 20 may be moved backward with its own weight so as to push the user to swing forward and backward. Since the feet of the user is suspended, the user may be stretched by its own weight so as to fully stretch the vertebra to be in right position.

Besides, since two hands of the user are supported on the support pieces 24 of the two cantilevers 20 respectively, two hands may hold tightly and harder so that the muscles of the arms, the back, and the abdomen may be exerted in series to achieve the effects of training muscles and exercise. It may further improve the pain or discomfort of the vertebra.

At the same time, the pose of the user may be not necessary to change and the user may know the stretching status and angle of the vertebra so as to adjust the swinging angle and speed of the stretching pose or length while operating. It may not be head on heels happened by the inversion machine. The user may be not dizzy due to head congestion to prevent from falling down and improve safety.

The foregoing descriptions are merely the exemplified embodiments of the present invention, where the scope of the claim of the present invention is not intended to be limited by the embodiments. Any equivalent embodiments or modifications without departing from the spirit and scope of the present invention are therefore intended to be embraced.

The disclosed structure of the invention has not appeared in the prior art and features efficacy better than the prior structure which is construed to be a novel and creative invention, thereby filing the present application herein subject to the patent law.

What is claimed is:

1. A vertebra recovery apparatus, comprising:

a main frame body;

a swing assembly, pivotally disposed on the main frame body and having two cantilevers, a middle section of each cantilever is provided with a support piece used for providing support under an armpit of each of two arms of a human body so that the human body stands in the swing assembly in a manner of suspending feet; and a driving module, disposed between the main frame body and the swing assembly, the driving module may drive the swing assembly to perform motion of swinging forwards and backwards.

2. The vertebra recovery apparatus as claimed in claim 1, wherein the main frame body has two stands arranged opposite to each other, the swing assembly has a shaft located between two top ends of the two stands, a top end of each cantilever has an axle sleeve pivoted to the shaft for providing the swing assembly to swing and pivot relative to the main frame body.

3. The vertebra recovery apparatus as claimed in claim 2, wherein the swing assembly has a width adjusting module, and the width adjusting module is arranged on the main frame body.

4. The vertebra recovery apparatus as claimed in claim 3, wherein the width adjusting module has a driving assembly arranged on a top plate of the main frame body, the driving assembly has an output screw rod, the output screw rod has a left threading section and a right threading section, two screw barrels are screwed with the left threading section and the right threading section respectively, a claw portion is arranged under each screw barrel, an elongated slot is formed at the top plate for providing the claw portion of each screw barrel to pass through, each claw portion is pivoted with the axle sleeve of each cantilever so as to drive the two cantilevers to move close to or away from each other to adjust a width between two cantilevers configured to match the human body while the driving assembly of the width adjusting module is rotated clockwise or counterclockwise.

5. The vertebra recovery apparatus as claimed in claim 1, wherein a height of the support piece may be selectively adjusted, and a top support portion is arranged at a top surface of the support piece for supporting the armpit of the human body, and a handle is arranged at an outside of the support piece for providing to be held.

6. The vertebra recovery apparatus as claimed in claim 5, wherein a first through hole is formed at the middle section of each cantilever for providing the support piece to slide up and down, two opposite inner sides of the first through hole have a first guiding portion respectively, two opposite side walls of the support piece have a second guiding portion respectively corresponding to the first guiding portion, a plurality of adjusting holes is formed on the cantilevers and the support piece from top to bottom in series so that a pin may be passed through one of the adjusting holes configured to match a height of the armpit of the human body.

7. The vertebra recovery apparatus as claimed in claim 1, wherein a riser assembly is arranged at two lower sections of the two cantilevers for each and the riser assembly is formed by a plate and the plate is capable for interposing between the two cantilevers, and a height of the plate may be selectively adjusted.

8. The vertebra recovery apparatus as claimed in claim 7, wherein a second through hole is formed at the lower section of each cantilever, two opposite inner sides of the second through hole have a third guiding portion respectively, a sliding block is arranged at each end of the plate of the riser assembly and slidably arranged in the second through hole corresponding to the lower sections of the two cantilevers, two opposite side walls of the sliding block has a fourth guiding portion respectively corresponding to each third guiding portion, a screw hole is formed at the sliding block, and a driving assembly is arranged on the riser assembly corresponding to each cantilever, an output end of the driving assembly has a screw rod for screwing with the screw hole of the sliding block to drive the sliding block to move up and down.

9. The vertebra recovery apparatus as claimed in claim 1, wherein the driving module is arranged under the swing assembly, the driving module has a base arranged in the main frame body, two driving wheels are arranged on the base and corresponding to the two cantilevers, a bottom end of each cantilever has a touch pad so that the driving module may use the friction between the driving wheels and the touch pad to drive the swing assembly to swing forward and backward.

10. The vertebra recovery apparatus as claimed in claim 1, wherein a stand assembly arranged on the swing assembly, the stand assembly includes a buttock pad arranged in a rear side of the two cantilevers and configured to correspond to a buttock of the human body, the stand assembly further includes an abdomen pad arranged at a front side of each cantilever, the abdomen pad may be selectively buckled to support the human body.

* * * * *